US006379135B2

(12) United States Patent
Schofield

(10) Patent No.: US 6,379,135 B2
(45) Date of Patent: Apr. 30, 2002

(54) VACUUM PUMPS

(75) Inventor: Nigel Paul Schofield, Horsham (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/791,527

(22) Filed: Feb. 22, 2001

(30) Foreign Application Priority Data

Feb. 24, 2000 (GB) ..... 0004404

(51) Int. Cl.[7] ..... F03C 2/00
(52) U.S. Cl. ..... 418/194; 418/95
(58) Field of Search ..... 418/194

(56) References Cited

U.S. PATENT DOCUMENTS 3,180,559 A * 4/1965 Boyd ..... 418/194
5,101,782 A * 4/1992 Yang ..... 418/9
5,215,501 A * 6/1993 Ushikoshi ..... 417/420
5,549,463 A * 8/1996 Ozawa ..... 418/9
6,129,534 A * 10/2000 Schofield et al. ..... 418/194
6,200,116 B1 * 3/2001 Schofield et al. ..... 418/194

FOREIGN PATENT DOCUMENTS

GB 384355 * 12/1932 ..... 418/194
SU 1437575 * 11/1988 ..... 418/194

* cited by examiner

*Primary Examiner*—Thomas Denion
*Assistant Examiner*—Theresa Trieu

(57) ABSTRACT

A compound vacuum pump includes a pump body divided by a partition into upper and lower chambers. A screw pump section occupies the lower chamber and a Roots-type pump section occupies the upper chamber. The Roots-type pump section comprises two rotors each with a disc for rotation in a bore of the partition.

4 Claims, 2 Drawing Sheets

VACUUM PUMPS

FIELD OF THE INVENTION

The present invention relates to "hybrid" or compound vacuum pumps which have two or more sections of different operational mode for improving the operating range of pressures and throughput; and more particularly, to oil free (dry) compound vacuum pumps.

BACKGROUND OF THE INVENTION

A screw pump comprising two externally threaded or vaned rotors mounted in a pump body and adapted for counter rotation in said body with intermeshing of the rotor threads is well known. Close tolerances between the rotor threads at the points of intermeshing and with the internal surfaces of the pump body causes volumes of gas being pumped between an inlet and an outlet to be trapped between the threads of the rotors and the internal surface of the pump body and thereby urged through the pump as the rotors rotate.

Such screw pumps are potentially attractive because they can be manufactured with few working components and they have an ability to pump from a high vacuum environment at the inlet down to atmospheric pressure at the outlet. However, such screw pumps suffer from low pumping speeds at relatively low pressures in the order of 500 mbar or less and, to overcome this problem, they are often fitted in tandem with a separate Roots-type pump to boost the pumping speed. The pumping capacity of the Roots-type pump can be up to 10 times that of the screw pump.

An example of a screw pump in tandem with a Roots-type pump is described in EP Publication No. 0965758 where a Roots stage occupies a first chamber of a "hybrid" pump adjacent an inlet to the pump and a screw pump stage occupies a second chamber of said pump adjacent an outlet from the pump.

However, it has been found that when pumping down from high inlet pressures a significant interstage pressure can develop between the Roots and the screw pump stages. This imposes a high force on the screw pump rotors and as a consequence the pump bearings.

It is an aim of the present invention to modify the Roots-type rotors to obviate this disadvantage.

SUMMARY OF THE INVENTION

According to the present invention, a compound vacuum pump comprises a screw pump section having a first shaft and space therefrom and parallel thereto a second shaft mounted in a pump body, a first rotor mounted on the first shaft and a second rotor mounted on the second shaft, each rotor being substantially cylindrical and having formed on an outer surface at least one helical vane or thread, the helical vanes or threads intermeshing together in a first chamber in the pump body so that rotary movement of the shafts will cause a fluid to be pumped from an inlet towards an outlet, the pump additionally including a Roots-type pump section including two mating Roots-type rotors also mounted on the said shafts and adapted for counter rotation in a second chamber in the pump body located at the inlet end of the pump, and wherein each Roots-type rotor has a disc for rotation in a bore of a partition separating said first and second chambers.

Preferably, the discs are circular in cross-section and each has a diameter slightly less than the centre distance between said first and second shafts.

BRIEF DESCRIPTION OF THE DRAWINGS

An embodiment of the invention will now be described, by way of example, reference being made to the Figures of the accompanying diagrammatic drawings in which.

DETAILED DESCRIPTION OF THE PREFERRED EMBODIMENT

Figure 1:
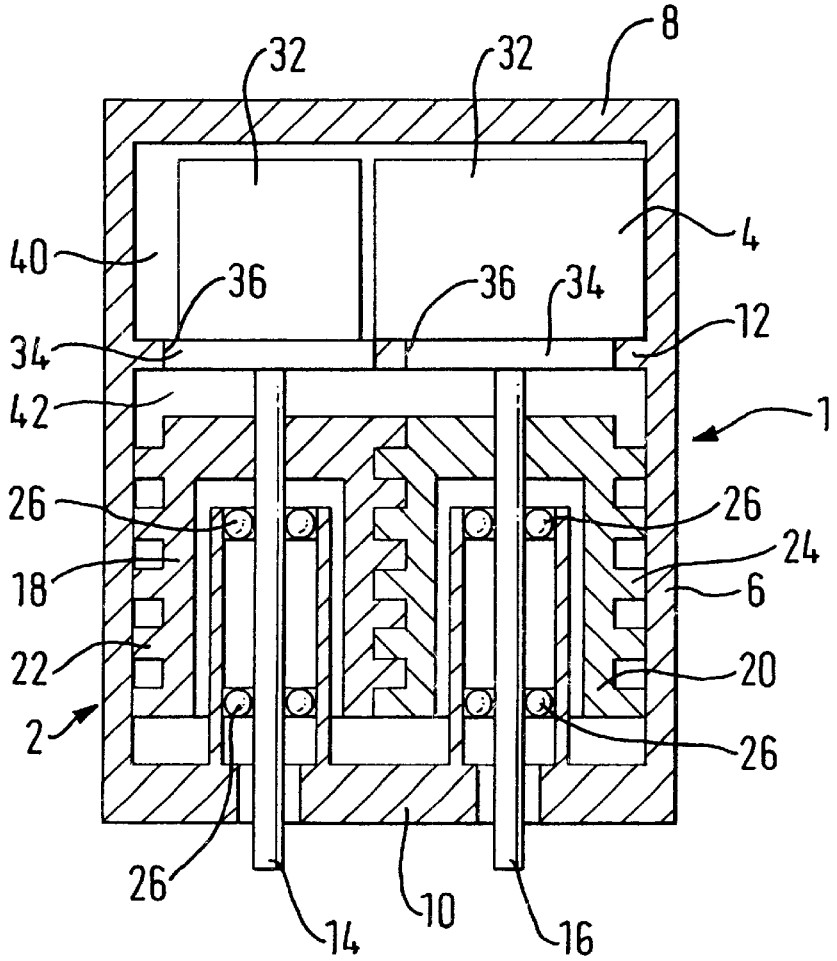
FIG. 1 is a cross-section through a compound vacuum pump according to the present invention.

Referring first to FIG. 1, a unitary vacuum pump 1 includes a pump body 6 having a top plate 8 and a bottom plate 10. Within the pump body 6 is a partition 12 which divides the interior of the pump body 6 into upper and lower chambers 40, 42; the upper (as shown) chamber 40 accommodating a Roots-type pump section 4 and the lower (as shown) chamber 42 accommodating a screw pump section 2. An inlet (not shown) to the pump 1 is formed in the top plate 8 and an outlet (not shown) is formed in the bottom plate 10. The pump body 6 defines an internal "figure of eight" shaped cavity (see FIG. 2).

The screw pump section 2 includes a first shaft 14 and spaced therefrom and parallel thereto a second shaft 16. Mounted for rotary movement with the first shaft 14 within the pump body 6 is a rotor 18 and mounted for rotary movement with the second shaft 16 within the pump body 6 is a rotor 20. The two rotors 18, 20 are of generally cylindrical shape and on the outer surface of each rotor there is formed a continuous helical vane or thread 22, 24 which vanes or threads intermesh as shown.

The rotors 18, 20 are hollow and each contains two spaced bearings 26 for supporting the respective shafts 14, 16.

Figure 2:
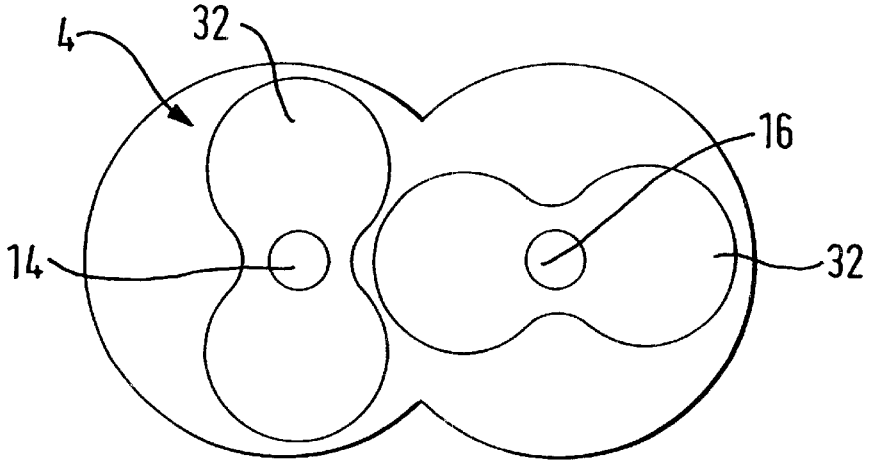
FIG. 2 is a diagrammatic plan view of a Roots-type pump section of the compound vacuum pump of FIG. 1.

As shown the shafts 14, 16 extend through the partition 12 and at their upper (as shown) ends within the upper chamber 40 of the pump body 6 support Roots-type profile rotors 32 (see also FIG. 2).

The shafts 14, 16 are adapted for rotation within the pump body 6 about their longitudinal axes in contra-rotational direction by virtue of the shaft 14 being connected to a drive motor (not shown) and by the shaft 16 being coupled to the shaft 14 by means of timing gears in a manner known per se. The rotors 32 are positioned on their respective shafts 14, 16 and located within the upper chamber 40 of the pump body 6 relative to the internal surfaces of the pump body 6 such that they can act in an intermeshing manner in a manner known per se in respect of vacuum pumps.

As aforesaid, in use both shafts 14, 16 rotate at the same speed but in opposite directions. Fluid to be pumped will be passed through the inlet in the top plate 8 and will be pumped by the Roots-type pump section 4 such that it passes out from the Roots-type pump section 4 through the partition 12 to enter the screw pump section 2. The overall shape of the rotors 18, 20 and in particular the vanes 22, 24 relative to each other and also relative to the inside surface of the pump body 6 are calculated to ensure close tolerances with the fluid being pumped from the inlet (top as shown) towards to the bottom plate 10 and the outlet defined therein.

Figure 3:
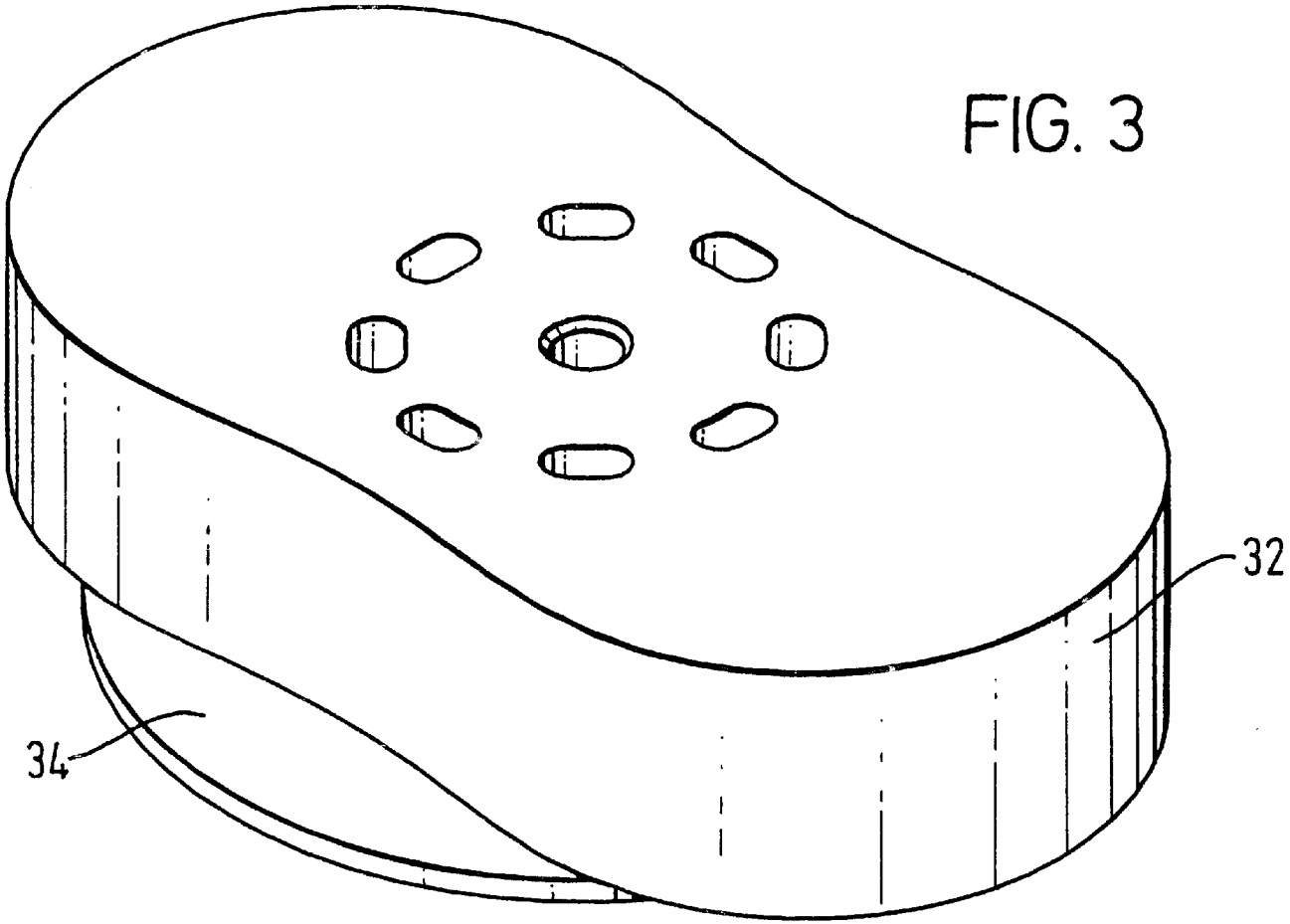
FIG. 3 is a perspective view of a Roots-type rotor modified in accordance with the present invention.

Referring also to FIG. 3, according to the present invention each Roots-type profile rotor 32 is formed with or has attached thereto a circular disc 34 which is located within a respective bore 36 in the partition 12 separating the Roots-type pump section 4 and the screw pump section 2.

Preferably, the discs 34 are each of a diameter slightly less than the centre distance between the shafts 14, 16.

During use, the discs 34 act as pressure relief pistons, the surface area of each disc being sufficiently large for any fluid under pressure between the sections 2, 4 to generate an upward (as shown) force on the underside (as shown) of each disc thereby offsetting the downward force generated by the pressure on the screw rotors 18, 20.

Although parallel screws are described and shown in FIG. 1 of the above embodiment, clearly the invention applies equally to compound vacuum pumps the screw pump section of which includes tapered screws as described and illustrated for example in European Patent Publication No. 0965758.

I claim:

1. A compound vacuum pump comprising a screw pump section having a first shaft and space therefrom and parallel thereto a second shaft mounted in a pump body, a first rotor mounted on the first shaft and a second rotor mounted on the second shaft, each rotor being substantially cylindrical and having formed on an outer surface at least one helical vane or thread, the helical vanes or threads intermeshing together in a first chamber in the pump body so that rotary movement of the shafts will cause a fluid to be pumped from an inlet towards an outlet, the pump additionally including a Roots-type pump section including two mating Roots-type rotors also mounted on the said shafts and adapted for counter rotation in a second chamber in the pump body located at the inlet end of the pump, and wherein each Roots-type rotor has a disc for rotation in a bore of a partition separating said first and second chambers.

2. The compound vacuum pump as claimed in claim 1, in which each disc is circular in cross-section and has a diameter slightly less than the centre distance between said first and second shafts.

3. The compound vacuum pump as claimed in claim 1 wherein said screw pump section contains tapered screws.

4. The compound vacuum pump as claimed in claim 1 which is oil free.

* * * * *